United States Patent [19]

Doerges

[11] Patent Number: 4,569,437

[45] Date of Patent: Feb. 11, 1986

[54] INCLINED FURNACE GRATE WITH AT LEAST ONE MOVABLE GRATE BAR

[75] Inventor: Eugen Doerges, Hamburg, Fed. Rep. of Germany

[73] Assignee: Richard Kablitz GmbH & Co. KG, Lauda, Fed. Rep. of Germany

[21] Appl. No.: 633,239

[22] Filed: Jul. 23, 1984

[30] Foreign Application Priority Data

Jul. 23, 1983 [DE] Fed. Rep. of Germany ..... 3326694

[51] Int. Cl.[4] ..... B65G 25/00

[52] U.S. Cl. ..... 198/773; 110/281; 110/328; 126/152 R; 126/175

[58] Field of Search ..... 198/773, 774; 110/281, 110/289–291, 328; 126/174, 175, 152 B, 152 R, 167; 34/164; 432/239

[56] References Cited

U.S. PATENT DOCUMENTS 3,255,867 6/1966 Allen et al. ..... 198/773
4,078,883 3/1978 Arnold ..... 34/164 X
4,201,545 5/1980 Riechert ..... 110/328 X

FOREIGN PATENT DOCUMENTS 0024844 3/1981 European Pat. Off. .

*Primary Examiner*—Joseph E. Valenza
*Assistant Examiner*—Darrell G. Dayoan
*Attorney, Agent, or Firm*—Joseph A. Geiger

[57] ABSTRACT

An inclined furnace grate for an industrial furnace or incinerator with transverse grate beams supporting a downwardly stepped succession of banks of stationary and reciprocating grate bars, the grate beams having arranged in their supporting surfaces removable bearing pads of abrasion-resistant, alloyed cast iron for the sliding support and lateral positioning of the reciprocating grate bars, thereby protecting the softer cast iron grate beams against sliding wear and abrasion. The removable bearing pads are received inside shallow recessed seats and retained in place by the adjacent stationary grate bars.

15 Claims, 2 Drawing Figures

INCLINED FURNACE GRATE WITH AT LEAST ONE MOVABLE GRATE BAR

BACKGROUND OF THE INVENTION

1. Field of the Invention

The present invention relates to industrial furnaces and incinerators and, more particularly, to an inclined furnace grate structure by means of which the fuel is advanced over a succession of downwardly stepped banks of grate bars. In at least some of these banks of grate bars, alternate grate bars execute longitudinal reciprocating movements to enhance the combustion process.

2. Description of the Prior Art

Furnace grate structures of the type mentioned have been known for a long time. They are especially suitable for furnace installations which burn low-energy solid fuels and combustible solid refuse with optimal efficiency. The reciprocating action of the movable grate bars and the cascading arrangement of successive banks of grate bars on downwardly stepped transverse grate beams make it possible to obtain a very effective stoking action.

The stoking action of such a furnace grate is readily adaptable to different requirements, through separate adjust ability of the grate bar movements in the various banks of grate bars. This adaptability gives the inclined furnace grate the capability of being used in furnaces which have to burn a wide variety of solid fuels.

In operation, the grate beams and grate bars of such a furnace grate structure are subjected to elevated thermal stress. In order to withstand this stress, the grate beams are normally grey iron castings and the grate bars are harder chromium-alloyed castings.

Over a period of time, the reciprocating movements of the grate bars produce mechanical wear and abrasion on the supporting surfaces of the grate beams. This wear condition is aggravated by the fact that small solid fuel particles tend to penetrate between the sliding surfaces, where they act as an abrasive substance between the sliding surfaces.

SUMMARY OF THE INVENTION

Underlying the present invention is the primary objective of improving the known inclined furnace grate structure in such a way that the earlier-mentioned abrasive wear on the supporting grate beams is substantially eliminated and the operational longevity of the furnace grate is correspondingly extended.

The present invention proposes to attain this objective by suggesting an inclined furnace grate structure for a furnace or incinerator of the type described further above which is improved through the arrangement of removable bearing pads between the supporting transverse grate beams and the supported end portions of the reciprocating grate bars, so as to transmit the bearing forces from the grate bars to the grate beams and to thereby protect the grate beams against sliding abrasion and wear by the reciprocating grate bars.

In a preferred embodiment of the invention, the removable bearing pads are received and positioned in matching recessed seats which are arranged in the supporting surfaces of the grate beams. The positioning of the removable bearing pads by means of recessed seats eliminates the need for securing the pads on the grate beams with screws or other fastener elements which tend to create considerable problems in furnace grates, due to corrosion.

While the bearing pads are thus longitudinally and transversely positioned by means of their recessed seats, they are retained inside these seats by the weight of the reciprocating grate bars sliding on them.

By way of another advantageous improvement, the present invention further suggests to arrange the bearing pads and their recessed seats in such a way that the bearing pads protrude laterally from both sides of the reciprocating grate bars, so as to reach a short distance under the adjacent stationary grate bars, which thereby prevent the removable bearing pads from falling out of their recessed seats.

Accordingly, in a preferred embodiment of the invention, in which the removable bearing pads and their recessed seats are of rectangular outline, the transverse width of the latter is in excess of the combined widths of a reciprocating grate bar and the two grate bar gaps separating it from the adjacent stationary grate bars.

The present invention makes it possible to select the pairing of the sliding surfaces of the removable bearing pads and reciprocating grate bars for specific wear and abrasion objectives. For example, by selecting for the bearing pads a material which is softer than the material of the transverse grate beams and also softer than the material of the reciprocating grate bars, all wear is concentrated on the bearing surfaces of the bearing pads, thereby protecting the grate beams and the grate bars against wear. For this purpose, the bearing pads are preferably so arranged that they protrude above their recessed seats. When they are worn down to the same level as the surrounding supporting surface of the grate beams, the bearing pads are simply replaced with new ones.

Alternatively, it is also possible to select for the removable bearing pads a material which is harder and therefore more abrasion-resistant than the material of the reciprocating grate bars. In this case, the transverse grate beams are protected against wear, even if they are softer. As the reciprocating grate bars become worn, they are replaced by new ones.

As a preferred pairing of sliding surfaces, the present invention suggests the use of an abrasion-resistant material for the removable bearing pads of a hardness which lies between the hardness of the transverse grate beams and the hardness of the reciprocating grate bars. Such a choice minimizes bearing wear on the reciprocating grate bars, at the same time as the removable bearing pads protect the softer grate beams against wear. It follows that the sliding wear is primarily concentrated on the removable bearing pads. The latter are readily replaceable when worn.

In order to achieve this preferred combination, the present invention suggests that both the removable bearing pads and the reciprocating grate bars be cast from tempered, chromium-alloyed cast iron, the grate bars being cast of a higher alloyed iron and/or treated for higher surface hardness. The much larger transverse grate beams, on the other hand, are preferably castings of plain grey cast iron.

BRIEF DESCRIPTION OF THE DRAWINGS

Further special features and advantages of the invention will become apparent from the description following below, when taken together with the accompanying drawings which illustrate, by way of example, a preferred embodiment of the invention which is represented in the various figures as follows.

DESCRIPTION OF THE PREFERRED EMBODIMENT

Figure 1:
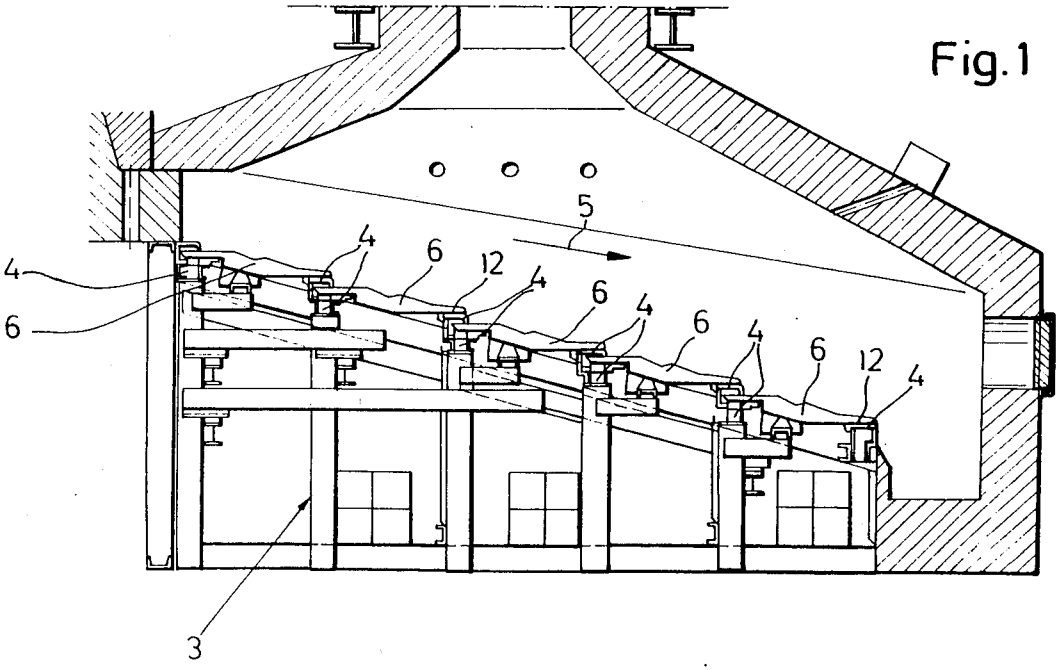
FIG. 1 shows a vertical longitudinal section in a schematic representation of the preferred embodiment.

FIG. 1 of the drawing gives a section through a furnace or incinerator which is equipped with an inclined furnace grate supported on a furnace substructure 3. The inclined furnace grate comprises a plurality of parallel horizontal grate beams 4 which are oriented transversely to the arrow 5 indicating the direction of advance of a layer of solid fuel (not shown) which is being combusted as it moves downwardly along the grate structure. The grate beams 4 are arranged at different levels and carry a succession of downwardly stepped banks of grate bars 6, giving the furnace grate structure an inclined, though uneven, upper surface.

Figure 2:
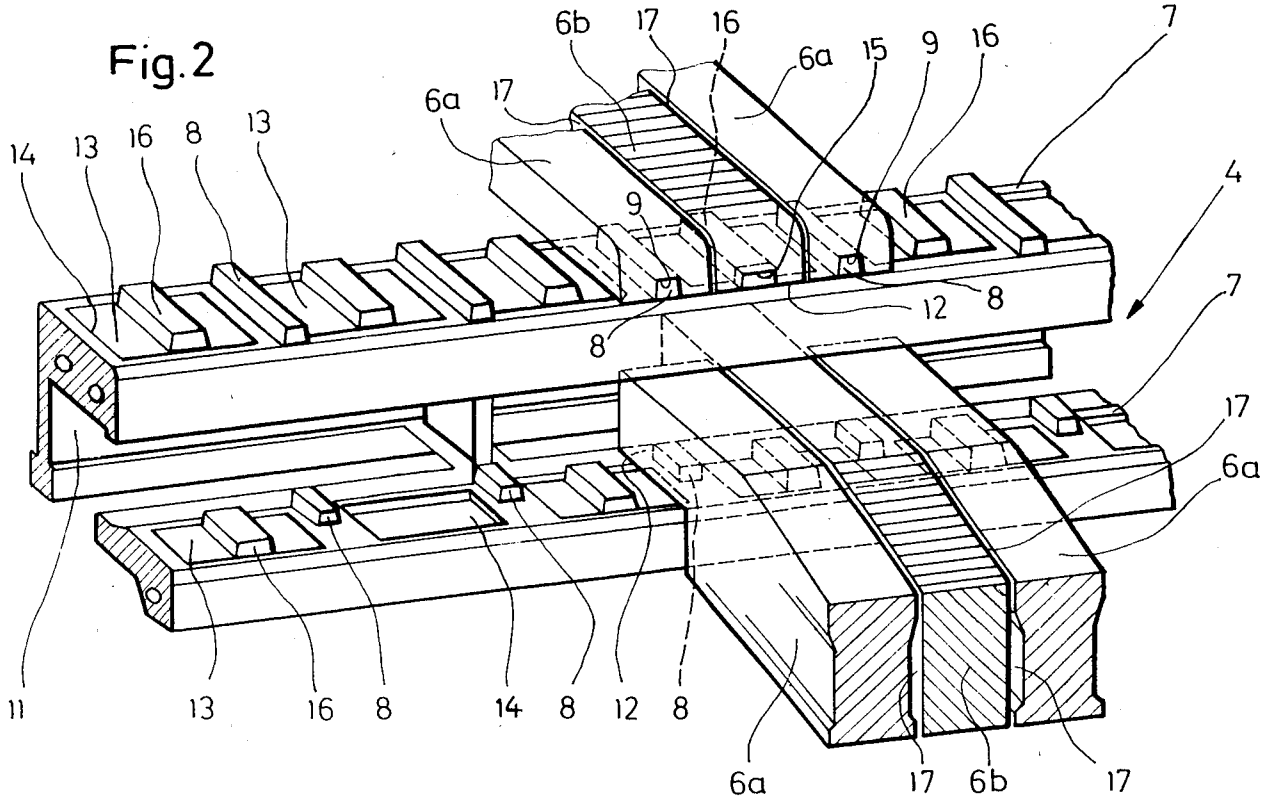
FIG. 2 shows, in an enlarged perspective view and in a likewise somewhat schematic representation, portions of two adjoining banks of grate bars of the furnace grate structure of FIG. 1, where the grate bars are supported on the transverse grate beams.

As can be seen in FIG. 2, each grate beam 4, with the exception of the first and last one, supports the lower end portions of a first bank of grate bars 6 on an upper tier and the upper end portions of an adjoining second bank of grate bars 6 on a lower tier, the grate beam tiers being so arranged that the lower end portions of the first bank of grate bars 6 form an overlap with the upper end portions of the second bank of grate bars.

FIG. 2 also shows that each bank of grate bars 6 consists of a number of stationary grate bars 6*a* which alternate with reciprocatingly movable grate bars 6*b*. The latter have transverse serrations on their upper surface to enhance their stoking action on the fuel material.

The stationary grate bars 6*a* are attached to the grate beam 4, their upper and lower end portions resting on substantially horizontal supporting surfaces 7 of the grate beam 4, the grate bars 6*a* being transversely positioned by means of longitudinally oriented positioning keys 8 on the grate beam 4 which cooperate with matching positioning grooves 9 in the stationary grate bars 6*a*.

The upper end portions of both the stationary grate bars 6*a* and the reciprocating grate bars 6*b* reach into a longitudinal recess 11 between the upper and lower tiers of the grate beam 4. The upper tier, by thus covering the extremities of the grate bars, forms an overlap between the two adjoining banks of grate bars.

The reciprocating grate bars 6*b*, while defining a stepped, downwardly slanting outline, execute a longitudinal movement along an approximately horizontal path. The reciprocating movement of the grate bars 6*b* is obtained by means of a known grate bar drive which is not part of the present invention and therefore not further described herein. As can be seen in FIG. 4, the upper extremities of the reciprocating grate bars 6*b* remain inside the longitudinal recess 11 of the grate beam 4 at all times.

The reciprocating grate bars 6*b* are likewise supported on the upper surfaces of the two tiers of the grate beam 4, where a sliding support is provided. For this purpose, the upper and lower end portions of the grate bars 6*b* have downwardly facing sliding surfaces 12 with which they engage upwardly facing bearing surfaces of special bearing pads 13 on the grate beam 4.

Each bearing pad 13 is positioned inside a recessed seat 14 in the supporting surface 7 of the grate beam 4, the thickness of the plate-like bearing pads 13 being equal to, or greater than, the depth of the recessed seats 14, so that the bearing surfaces of the bearing pads 13 are at the same level as the supporting surfaces 7 of the grate beam 4 or, preferably, at a slightly higher level.

In the midportion of each bearing pad 13 is arranged a longitudinally oriented guide key 16 which cooperates with a matching longitudinal guide groove 15 in the associated sliding surface 12 of the reciprocating grate bar 6*b*. The depth of the guide groove 15 is at least equal to the height of the guide key 16. By way of a modification, it is also possible to arrange multiple guide keys on each bearing pad which cooperate with corresponding multiple guide grooves in the reciprocating grate bars 6*b*.

As can be seen in FIG. 2, the reciprocating grate bars 6*b* alternate with stationary grate bars 6*a* so that each reciprocating grate bar 6*b* is flanked by two stationary grate bars 6*a*. The spacing between the positioning keys 8 for the stationary grate bars 6*a* is such that the latter form precisely defined grate bar gaps 17 with the reciprocating grate bars 6*b*. The guide keys 16 of the bearing pads 13 are centered between the positioning keys 8. The grate bar gaps 17 are chosen so narrow that it is impossible to a very large extent that fuel particles fall through the gaps 17.

The width of the recessed seats 14 for the bearing pads 13, as measured in the longitudinal direction of the grate beam 4, is preferably such that it is greater than the combined widths of the reciprocating grate bar 6*b* and its grate bar gaps 17 on both sides, with the result that the lateral extremities of each bearing pad 13 reach under two stationary grate bars 6*a*. This arrangement provides a simple and effective way of securing the bearing pads 13 in their recessed seats 14 by means of the stationary grate bars 6*a*.

For the wearing-in and seating of the reciprocating grate bars 6*b* on the grate beams 4, it is important that the supporting surfaces 7 of the grate beams 4 are protected against wear from the harder reciprocating grate bars 6*b* by restricting the support of the latter to the bearing pads 13. For this purpose, it is important that the thickness of the bearing pads 13 is at least equal, but preferably greater than the depth of the associated recessed seats 14, so that the upper surface of a bearing pad 13, if it is not aligned with the surrounding supporting surface 7 of the grate beam 4, protrudes above the latter.

Accordingly, in the production of the bearing pads 13, their thickness tolerances are chosen in such a way that they preclude the possibility that the thickness of a bearing pad 13 is less than the depth of the associated recessed seat 14. A similar situation applies in the relationship between the depth of the guide groove 15 in the reciprocating grate bar 6*b* and the height of the guide key 16 on the bearing pad 13.

The initial configuration of the supporting surfaces at the beginning of the seating process is therefore normally such that the bearing surface of the bearing pad 13 protrudes over the supporting surface 7 of the grate beam 4 and that a small gap exists between the upper surface of the guide key 16 and the bottom of the guide groove 15.

As a result of surface wear during the seating process, the bearing surface of the bearing pad 13 may be lowered to such an extent that the sliding surface 12 of the reciprocating grate bar 6*b* is supported simultaneously on the bearing surfaces of the bearing pad 13 and on the supporting surface 7 of the grate beam 4. Even in this configuration, the supporting surface 7 of the grate beam 4 is protected against wear, because the material of the bearing pad 13 is harder than the material of the grate beam 4, so that the rate of wear is determined by the harder bearing surface of the bearing pad 13, which is a considerably lower rate of wear than that of the supporting surface 7 of the grate beam 4.

As seating wear occurs on the bearing surface of the bearing pad 13, the guide key 16 penetrates deeper into the guide groove 15 of the stationary grate bar 6*a*, until supporting contact is established between its upper surface and the bottom of the guide groove 15. The result is a solid and precisely defined seating configuration between the reciprocating grate bar 6*b* and the bearing pad 13, with a minimum of operational wear on the bearing surfaces of the reciprocating grate bar 6*b* and the cooperating bearing surfaces of the bearing pad 13 of slightly softer material.

A suitable material for the bearing pads 13 is heat-resistant, hardened chromium-alloyed cast iron with a high chromium content, for example 165 Cr Mo V 15.

It should be understood, of course, that the foregoing disclosure describes only a preferred embodiment of the invention and that it is intended to cover all changes and modifications of this example of the invention which fall within the scope of the appended claims.

What is claimed is:

1. An inclined furnace grate structure for a furnace or incinerator over which solid fuel advances forwardly and downwardly in an advance direction substantially parallel to an imaginary vertical plane as it is combusted, said grate structure being supported on a substructure and comprising:

at least two parallel grate beams extending substantially transversally to said imaginary vertical plane, the first grate beam in said advance direction being located on a higher level and forms a first upwardly facing supporting surface and the second one being located on a lower level and forms a second upwardly facing supporting surface;

at least a first bank of elongated grate bars which extend substantially parallel to said imaginary vertical plane in spaced relation to each other and have upwardly facing supporting surfaces for said solid fuel and upper and lower end portions which are supported on said first and second supporting surfaces of said first and second grate beam, respectively, so that said supporting surfaces of said grate bars being inclined in said advance direction, at least one of said grate bars being reciprocatingly movable parallel to said imaginary vertical plane;

wear means which are interposed between said supporting surfaces of said grate beams and said end portions of said reciprocatingly movable grate bar forming bearing surfaces for said end portions of said reciprocatingly movable grate bar, so as to protect said grate beams against sliding abrasion and wear by said reciprocatingly movable grate bar, characterized by the improvement that said wear means being removably supported on said supporting surfaces of said grate beams and that abutment means being provided which form abutment surfaces for said wear means, said abutment surfaces forming positive stops which prevent substantially a movement of said wear means along said supporting surfaces of said grate beams at least in a direction parallel to said imaginary vertical plane, and permit to lift up said wear means from said grate beams when at least said reciprocatingly movable grate bar is removed from said grate beams.

2. A furnace grate structure as defined in claim 1, wherein recesses for receiving said wear means are provided in said supporting surfaces of said grate beams, said recesses having a depth and inner side walls forming said abutment surfaces for said wear means.

3. A furnace grate structure as defined in claim 1, wherein at least two of said grate bars are stationary supported on said grate beams in spaced relations to each other, so as to receive said reciprocatingly movable grate bar between said two stationary grate bars, and wherein said removable wear means protrude laterally from both sides of said reciprocatingly movable grate bar, so as to reach under the adjacent stationary grate bars and to be vertically secured by the latter.

4. A furnace grate structure as defined in claim 2, wherein at least two of said grate bars are stationary supported on said grate beams in spaced relation to each other, so as to receive said reciprocatingly movable grate bar between said two stationary grate bars, and wherein said movable wear means protrude laterally from both sides of said reciprocatingly movable grate bar, so as to reach under the adjacent stationary grate bars and to be vertically secured by the latter.

5. A furnace grate structure as defined in claim 4, wherein said inner walls of each of said recesses form a closed outline, each of said wear means forms a plate having an outline matching substantially said outline of said recesses.

6. A furnace grate structure as defined in claim 5, wherein said wear plates have a thickness which is at least equal to said depth of said recesses, so as to locate said bearing surfaces of said wear plates at a level which is at least as high as that of said surrounding supporting surfaces of said grate beams.

7. A furnace grate structure as defined in claim 6, wherein the thickness of said wear plates exceeds the depth of said recesses by an amount which is approximately equal of the amount of wear which takes place on said bearing surfaces of said wear plates during the operation of said reciprocating grate bar.

8. A furnace grate structure as defined in claim 6, wherein each of said wear plates has a guide means on said bearing surface and said reciprocatingly movable grate bar has guide means at both of said upper and lower end portions for cooperating with said guide means of said wear plates.

9. A furnace grate structure as defined in claim 8, wherein said guide means on said bearing surface is a longitudinal key and said guide means at both of said upper and lower end portions of said reciprocatingly movable grate bar are guide grooves for receiving said guide keys of said wear plates.

10. A furnace grate structure as defined in claim 3, wherein said supporting surfaces of said grate beams have positioning means for positioning said two stationary grate bars and each of said wear means has a guide means for said reciprocatingly movable grate bar, said guide means and said positioning means being located in such distances from each other that grate gaps are defined between said reciprocatingly movable grate bar and said stationary grate bars.

11. A furnace grate structure as defined in claim 1, wherein behind said first bank of grate bars at least one second bank of grate bars is provided in said advance direction, said lower end portions of said grate bars of said first bank and said higher end portions of said grate bars of said second bank being supported on a common grate beam.

12. A furnace grate structure as defined in claim 11, wherein said common grate beam has an upper and a lower tier, said upper tier forms said second supporting surface for said lower end portions of said grate bars of said first bank and said lower tier forms said first supporting surface for said higher end portions of said grate bars of said second bank.

13. A furnace grate structure as defined in claim 12, wherein at least two of said grate bars of each of said at least two banks are stationary supported on said grate beams in spaced relations to each other, so as to receive said reciprocatingly movable grate bar between said two stationary grate bars, and wherein said removable wear means protrude laterally from both sides of said reciprocatingly movable grate bar, so as to reach under the adjacent stationary grate bars and to be vertically secured by the latter.

14. A furnace grate structure as defined in any one of claims 1 through 13, wherein said removable wear means is made of a heat-resistant material which is harder and more resistant against abrasion by said reciprocating grate bar than the material of said grate beams; and said reciprocating grate bar is made of a heat-resistant material which is harder and more resistant against abrasion than the material of said removable wear means.

15. A furnace grate structure as defined in any one of claims 1 through 13, wherein said grate beams are castings of grey iron; and said removable wear means and said reciprocatingly movable grate bar are castings of tempered chromium-alloyed cast iron of different hardness.

* * * * *